US009314988B2

(12) United States Patent
Zanarella et al.

(10) Patent No.: US 9,314,988 B2
(45) Date of Patent: Apr. 19, 2016

(54) HANDLE-FORMING MACHINE

(75) Inventors: Paolo Zanarella, Padua (IT); Marco Zanchin, Padua (IT)

(73) Assignee: FLAT SYSTEMS S.R.L., Padua (IT)

( * ) Notice: Subject to any disclaimer, the term of this patent is extended or adjusted under 35 U.S.C. 154(b) by 478 days.

(21) Appl. No.: 13/703,447

(22) PCT Filed: Apr. 18, 2011

(86) PCT No.: PCT/IB2011/051664

§ 371 (c)(1),
(2), (4) Date: Dec. 11, 2012

(87) PCT Pub. No.: WO2011/158132

PCT Pub. Date: Dec. 22, 2011

(65) Prior Publication Data

US 2013/0203577 A1 Aug. 8, 2013

(30) Foreign Application Priority Data

Jun. 16, 2010 (EP) ..... 10425201

(51) Int. Cl.
*B31D 1/06* (2006.01)
*B31B 1/00* (2006.01)

(52) U.S. Cl.
CPC ... *B31D 1/06* (2013.01); *B31B 1/00* (2013.01); *B31B 2219/9077* (2013.01)

(58) Field of Classification Search
CPC ..... B31B 1/00; B31B 2219/9077; B31D 1/06
USPC ..... 493/226, 228, 231, 241, 243, 88
See application file for complete search history.

(56) References Cited

U.S. PATENT DOCUMENTS 2,529,976 A * 11/1950 Strandberg ..... 493/221
3,034,409 A 5/1962 Finke et al.

(Continued)

FOREIGN PATENT DOCUMENTS

DE 1181035 B 11/1964
FR 2013115 A1 3/1970

(Continued)

OTHER PUBLICATIONS

International Search Report and Written Opinion dated Jul. 21, 2011.

(Continued)

*Primary Examiner* — Thanh Truong
*Assistant Examiner* — Dianne Mitchell
(74) *Attorney, Agent, or Firm* — Thomas Horstemeyer, LLC

(57) ABSTRACT

Handle-forming machine for shaping and attaching strap handles to bags or carrier bags, and/or to continuous rolls of paper to make bags or carrier bags, said strap handles being formed by folding substantially into a U shape at least one strip or strap. The handle-forming machine comprises at least one carousel rotating around a main shaft, said carousel in turn comprising one or more cradles for gripping and folding the straps. Advantageously each cradle rotates around a main shaft at least from a feed station of said strap/s, to a folding station into a U shape of each strap and to a loading station of the folded strap, for attachment to the bag or to the continuous roll of paper which the bag will be made from. Moreover the cradle also rotates around its own axis radial to the main shaft, to rotate the position of the relative strap between the folding and loading feed stations.

13 Claims, 9 Drawing Sheets

(56) References Cited

U.S. PATENT DOCUMENTS

| | | | | | |
|---|---|---|---|---|---|
| 3,424,067 | A | * | 1/1969 | Blair | 493/304 |
| 3,439,591 | A | * | 4/1969 | Class | 493/221 |
| 3,554,099 | A | * | 1/1971 | Rodley | 493/221 |
| 3,613,523 | A | * | 10/1971 | Wesselmann | 493/221 |
| 3,660,204 | A | | 5/1972 | Wesselmann et al. | |
| 3,706,625 | A | * | 12/1972 | Jones et al. | 156/517 |
| 3,753,824 | A | * | 8/1973 | Bosse | 156/227 |
| 3,818,810 | A | * | 6/1974 | Bosse | 493/221 |
| 3,850,724 | A | * | 11/1974 | Lehmacher | 156/201 |
| 5,356,221 | A | * | 10/1994 | Achelpohl et al. | 383/21 |
| 5,382,215 | A | * | 1/1995 | Mattiebe | 493/221 |
| 6,574,940 | B2 | * | 6/2003 | Dauder Guardiola | 53/134.1 |
| 7,322,919 | B2 | * | 1/2008 | Malini | 493/175 |
| 2005/0119101 | A1 | * | 6/2005 | Constant | 493/221 |
| 2010/0331159 | A1 | * | 12/2010 | Chiu et al. | 493/226 |

FOREIGN PATENT DOCUMENTS

| | | |
|---|---|---|
| JP | 49-42470 | 4/1974 |
| JP | 54-004317 | 3/1979 |

OTHER PUBLICATIONS

English Translation of Office Action dated Sep. 24, 2014; Japanese patent application No. 2013-514806; 3 pages.

* cited by examiner

HANDLE-FORMING MACHINE

CROSS-REFERENCE TO RELATED APPLICATION

This application is the 35 U.S.C. §371 national stage of PCT application PCT/IB2011/051664, filed Apr. 18, 2011, which claims priority to and the benefit of European Application No. 10425201.0, filed Jun. 16, 2010, both of which are hereby incorporated by reference in their entirety.

FIELD OF THE INVENTION

The present patent relates to equipment for the production of bags or shopping bags in paper or other materials, and specifically relates to a carousel handle-forming machine to shape and attach the handles to said bags.

BACKGROUND OF THE INVENTION

Machinery and systems for the production of paper bags or carrier bags comprising various stations and equipment for the shaping and production of the bag, obtained by cutting and folding a strip of paper or other material, and one or more devices, commonly known as handle-forming machines, for shaping and attaching the handles, are known of.

Various types of handle-forming machines are known of which envisage operations of unwinding one or more paper and/or cord strips, from which each handle is made, of folding and cutting said strip to size to form each handle, and applying the handle to the bag or in continuum, to the roll of paper which the bag will be made from.

The handle-forming machines of the prior art have many drawbacks and disadvantages.

In particular, the handle-forming machines applying handles in continuum to the roll of paper which the bags will subsequently be made from are extremely complicated from a mechanical point of view and, in addition, given their functioning, are subject to jamming and accidental interruption of the manufacturing process.

In fact, as the production speed increases, the risk of a single handle not being perfectly attached to the roll of paper, with the risk of the detached or partially detached handle getting jammed in the mechanisms of the handle-forming or bagging machine and causing dangerous obstruction, increases exponentially.

Such obstructions may not only lead to prolonged downtime of the machine but also to damage of one or more parts of the machine itself.

Currently the production speed of paper or similar bags with a flat bottom is approximately 1000 pieces per minute, while the production speed of paper or similar bags with a square bottom is slower, about 150 pieces a minute.

Such production speed is not supported however by the known handle-forming machines, which need to keep the speed of shaping and attaching the handles to lower levels so as to prevent such risks of jamming.

Handle-forming machines for making so-called strap handles, that is each comprising a segment of paper or similar, folded once or more in a longitudinal direction, to form a linear strap are also known of. The end sections are then folded in relation to the central section to form a substantially U-shaped strap. Said strap handles are attached to the roll of paper after applying glue to the sides folded into a U and to a transversal reinforcement patch of said sides folded into a U.

To make the strap type handles, the handle-forming machine is fed with one or more strips of paper, which are usually folded once or more, as many as four times in a longitudinal direction, to make a more rigid strip.

The continuous strip is cut to size and grasped by rotating drums with grippers which cause folding of the strap. The strap is then rotated and attached to the preformed bag or to the roll of paper which the bag will be subsequently made from, by a plurality of drums.

To prevent the strap from shifting or moving away from the surface of the drum or drive belt during the exchange between various drums, suction devices are used inside the drums or under the belts to keep said straps perfectly adherent to the surface of the drum or belt.

In addition, on account of the presence of said sliding belts, the speed of the handle-forming machines cannot be increased beyond determined limits, which would entail excessive mechanical stress on the belts themselves, with the risk of breakage.

In the known handle-forming machines the rollers must work in perfect synchrony, with the maximum precision, to limit the amount of jamming, which is however inevitable.

SUMMARY OF THE INVENTION

To overcome the aforementioned drawbacks a new type of carousel handle-forming machine has been designed and produced for the continuous application of strap handles to continuous rolls of paper for the subsequent production of paper or similar bags and carrier bags.

The main purpose of the present invention is to increase the hourly production of bags and carrier bags, maximising the speed of the shaping and attaching phase of the strap handles.

Another purpose of the present invention is to eliminate the risk of jamming and shifting of the straps from the correct position during the shaping phases, since each strap is kept gripped by a single device or cradle, throughout the folding and positioning phases, without having to pass from one device to another as happens with the known handle-forming machines.

Another purpose of the present invention is to ensure continuity in the shaping and attachment phase of the handles, without having to invert the direction of advancement of the handles in a discontinuous manner.

Another purpose of the present invention is to avoid the use of rollers and drive belts for the straps as well as of suction devices, thereby almost completely eliminating the risk of jamming connected with the use of the aforesaid devices.

These and other purposes are achieved by a handle-forming machine according to claim 1.

BRIEF DESCRIPTION OF THE DRAWINGS

The characteristics of the handle-forming machine according to the present invention will be clearer from the following description made by way of a non-limiting example with reference to the attached drawings, wherein.

DETAILED DESCRIPTION OF THE INVENTION

Figure 1:
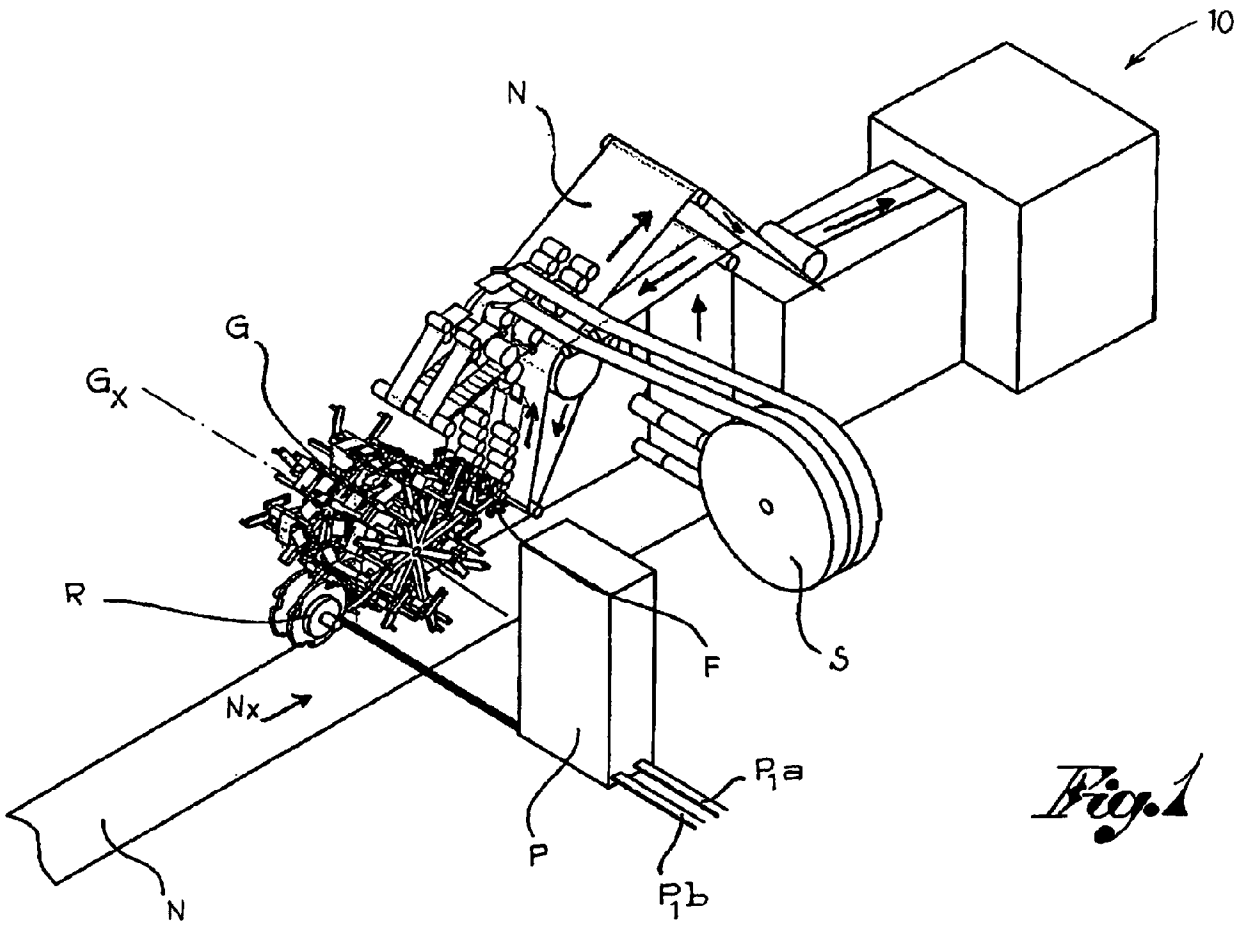
FIGS. 1 and 2 show two perspective views, from different angles, of a handle-forming machine according to the present invention.
Figure 2:
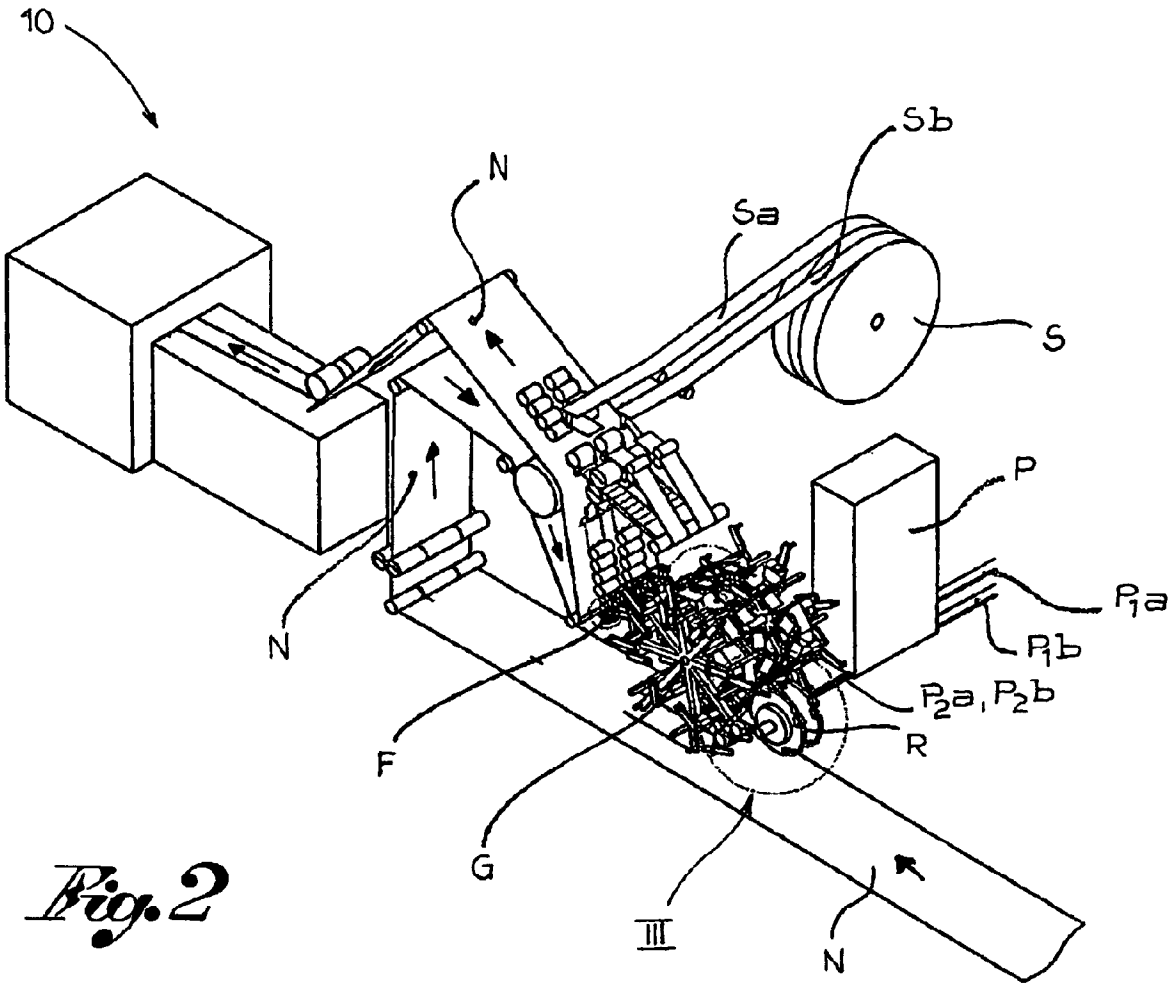

In the aforesaid figures, reference numeral (10) globally denotes a handle-forming machine for shaping and attaching strap handles (M') to bags or carrier bags, in paper or other material and/or to continuous rolls of paper (N) for making bags or carrier bags, in paper or other material, said strap handles (M') being formed by substantially folding into a U shape at least one strip or strap (M), in paper or other material.

The handle-forming machine (10) comprises at least one carousel (G) rotating around a main shaft (Gx), said carousel (G) in turn comprising a plurality of arms (B) substantially radial to the main shaft (Gx), and one or more cradles (C) or devices for gripping and folding one or more straps (M), the cradles (C) being distributed radially on the carousel (G). Preferably, each cradle (C) is mounted at the end of one of the arms (B).

Each of the cradles (C) rotates jointly with the corresponding arm (B) to which it is attached, specifically the cradle (C) rotates around the main shaft (Gx) at least from one strap/s (M) feed station (1) to one station (4) folding each strap (M') into a U shape and to one loading station (5) of the folded strap (M'), for attachment to the bag or continuous roll of paper (N) which the bag will be made from.

Each of the cradles (C) swivels and also rotates around its own axis (Cx) radial to the main shaft (Gx), that is incident and perpendicular to the latter, to rotate the position of the relative strap (M) between the feed (1), folding (4) and loading (6) stations.

During the rotation of the carousel (G), around the main shaft (Gx), and of the cradles (C), each around its own radial axis (Cx), each strap (M) is also substantially folded into a U shape, to form the handle (M'), and is positioned correctly for its final attachment to the continuous roll which the bags will be made from.

According to one embodiment, the handle-forming machine (10) comprises at least two series of cradles (Ca, Cb) and two series of radial arms (Ba, Bb) rotating in a synchronised manner around said axes (Gx, Cx), each of the cradles (Ca) and the relative arm (Ba) of one series being flanked with a relative cradle (Cb) and relative arm (Bb) of the second series.

In other words, the arms (B) rotate around the main shaft (Gx) in a synchronised manner, to remain flanked and parallel in pairs at all times so that the cradles (C) too, and therefore the two straps (M) respectively restrained by each cradle (C), are always kept in corresponding positions during rotation around the main shaft (Gx), to be folded into a U, rotated and then loaded in a synchronised manner and at the same height onto said roll (N) of paper or other material.

The handle-forming machine (10) comprises at least one unwinding and folding station (P) of one pair of continuous strips (P1*a*, P1*b*) flanked for the realisation of said straps (M), one for each of the series of cradles (Ca, Cb). In the unwinding and folding station (P) of the roll of paper (N), each of the strips (P1*a*, P1*b*) is folded once or more in the longitudinal direction of the strip (P1*a*, P1*b*) so as to form continuous folded strips (P2*a*, P2*b*) for the realisation of the straps (M). Such folding makes said strips more rigid.

Figure 3:
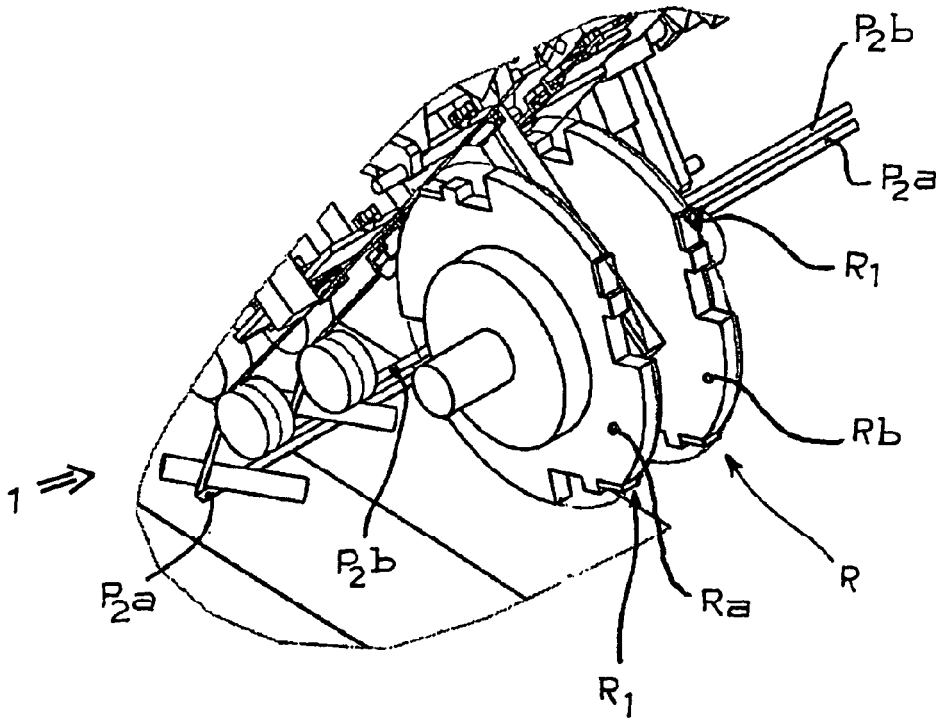
FIG. 3 shows the part III in FIG. 2 in detail.

The handle-forming machine (10), as shown in FIG. 3, also comprises at least one rotor (R, Ra, Rb) with knives (R1) for cutting the continuous strips (P2*a*, P2*b*) to size, the continuous strips (P2*a*, P2*b*) being grasped by at least one gripper (C2) of one of the cradles (Ca, Cb) of the relative series, that is by the cradle (Ca, Cb) situated in the feed position (1), and where said rotor/s (R, Ra, Rb) cut each of the strips (P2*a*, P2*b*) to size forming one straight linear strap (M) grasped by the relative cradle (Ca, Cb) which continues in its rotation around the shaft (Gx) and around the relative radial axis (Cx).

Each of the cradles (C) in the feed position (1) is positioned so that the strap (M), initially straight and linear is positioned tangentially to the rotary movement of the cradle (C) around the main shaft (Gx) and orthogonally to the main shaft itself.

Figure 4:
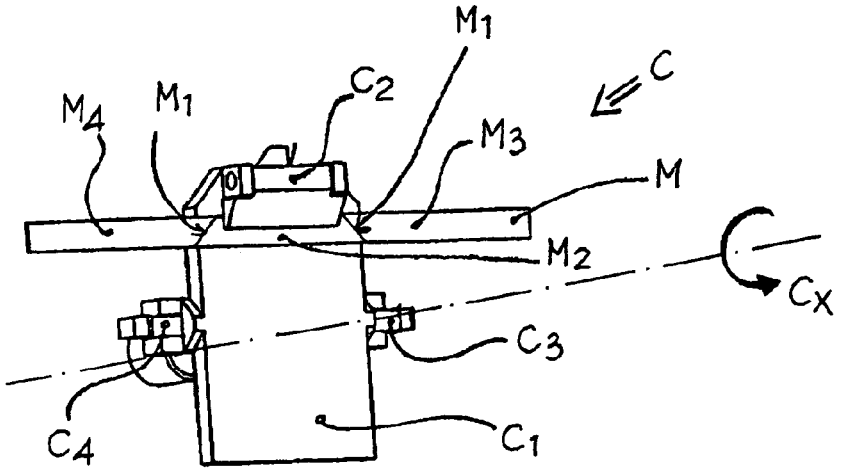
FIG. 4 shows a cradle (C) gripping a single strap (M), initially in a non-folded, straight linear configuration.
Figure 5:
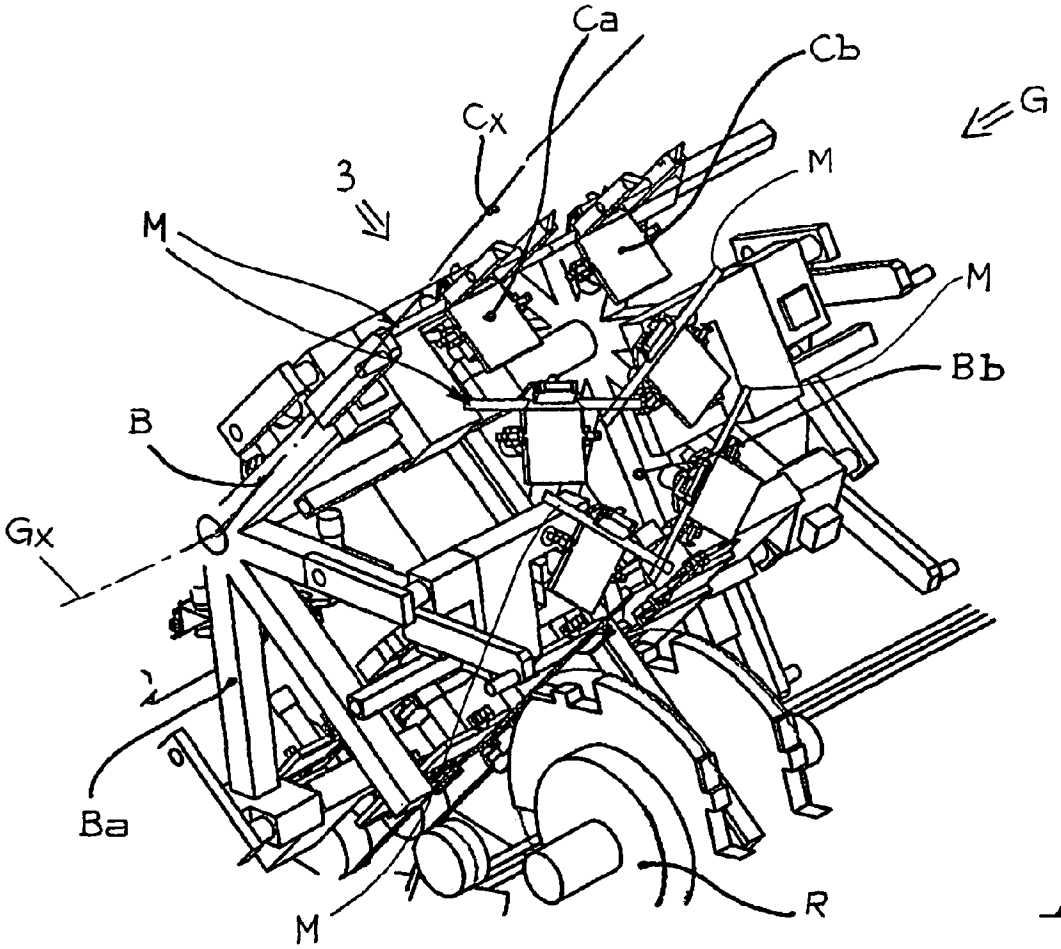
FIG. 5 shows the cradles (Ca, Cb) mounted on the carousel (G) of the handle-forming machine.

Each of the cradles (C) therefore rotates around the main shaft (Gx) from the feed position (1) of the strap (M) to a scoring position (3) of the strap (M) along folding lines (M1) (FIG. 4). The cradle (C) also rotates around a relative radial axis (Cx) by an angle of 90°, placing the strap (M) parallel to the main shaft (Gx) in the scoring or punching position (3) (FIG. 5).

Figure 6:
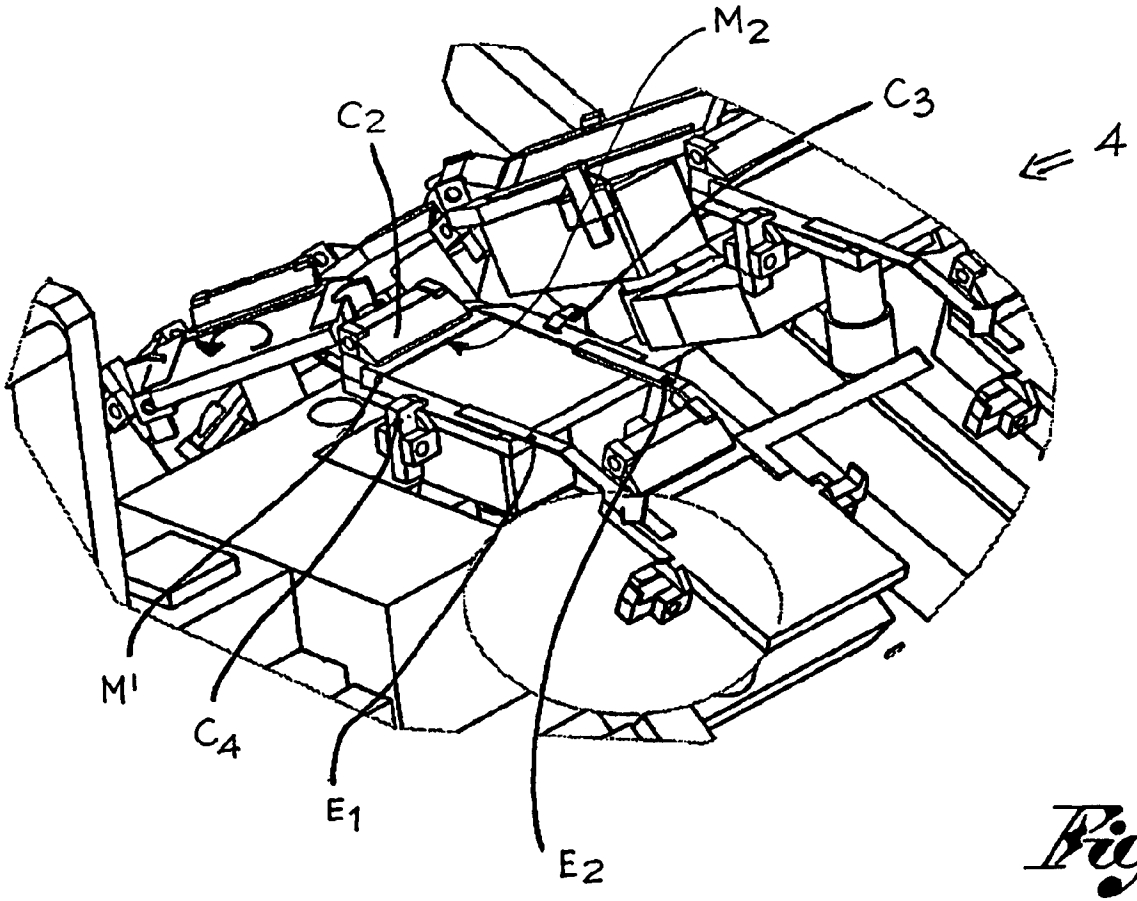
FIG. 6 shows a folding station (4) of the strap (M) bound to its relative cradle (C) into a U.

In the scoring position, the strap (M) is punched or scored with slots, that is folding lines (M1), to facilitate its subsequent folding into the desired form. Such folding is performed with the help of one or more guides (E1, E2) (FIG. 6).

Said guides (E1, E2) mounted on the carousel (G) cause the raising and folding of two opposite lateral sections (M3, M4) of the strap (M), so that it is finally substantially bent into a U shape, presenting a linear central side or section (M2) and lateral sections or sides (M3, M4) folded in relation to said central section (M2), and where the folded strap (M') is placed, in the folding position (4), with the central side (M2) parallel to the main shaft (Gx) of the carousel (G), and the lateral sections (M3, M4) facing opposite the direction of rotation around the main shaft (Gx).

The folded straps (M') are retained by the relative cradle (C), which comprises a central gripper (C2) retaining the central section (M2) of the folded strap (M'), and two further lateral grippers (C3, C4) which respectively retain said two lateral sections (M3, M4) of the folded strap (M').

Figure 7:
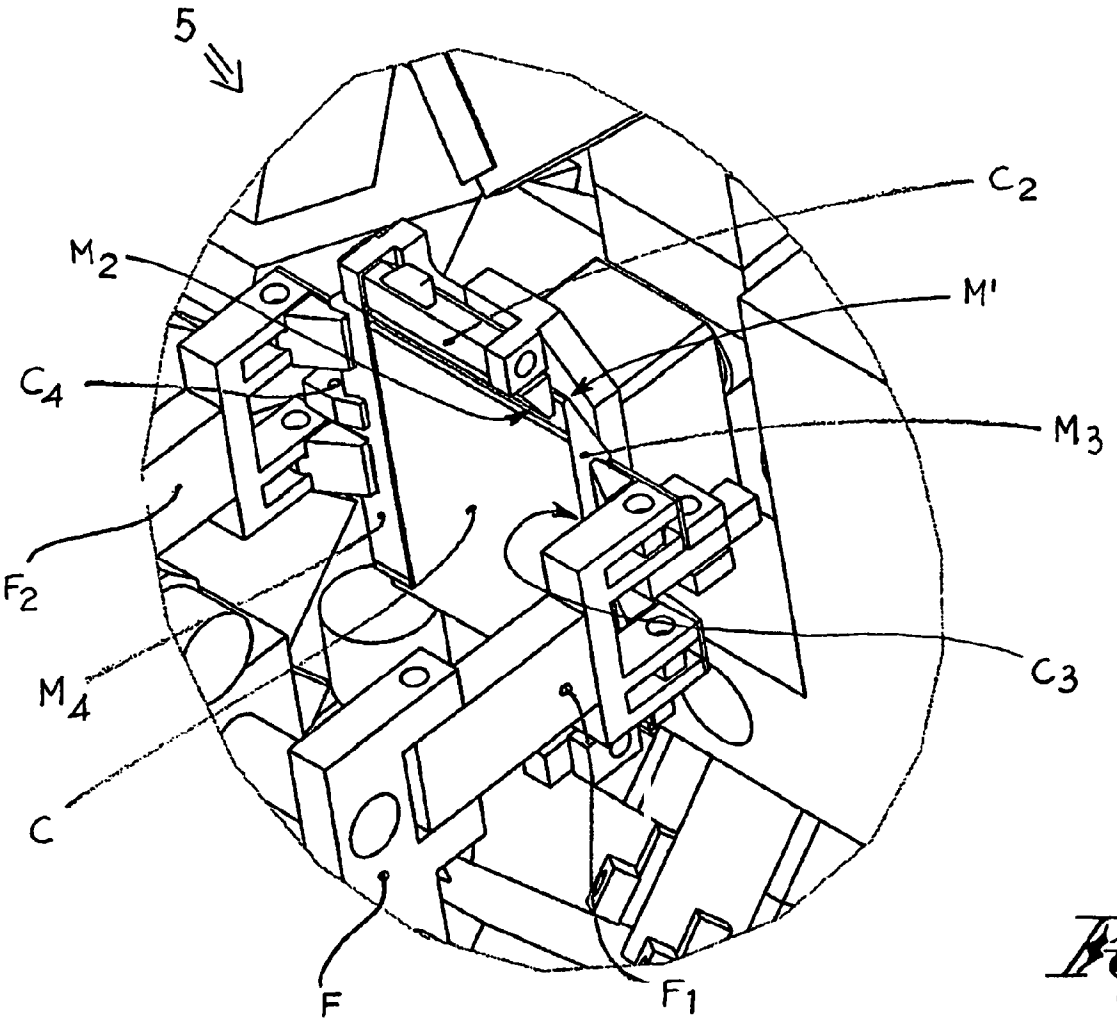
FIG. 7 shows a loading station (5) of the folded strap (M') from the carousel (G) to the loader (F)

So (FIG. 7), each cradle (C) further rotates around the main shaft (Gx) from the position of folding into a U (4) to the loading position (5), contemporarily rotating around the relative radial axis (Cx) by 180°, so that the folded strap (M') has the central side (M2) positioned parallel to the main shaft (Gx) and the lateral sections (M3, M4) facing in the same direction as the direction of rotation around the main shaft (Gx).

Figure 8:
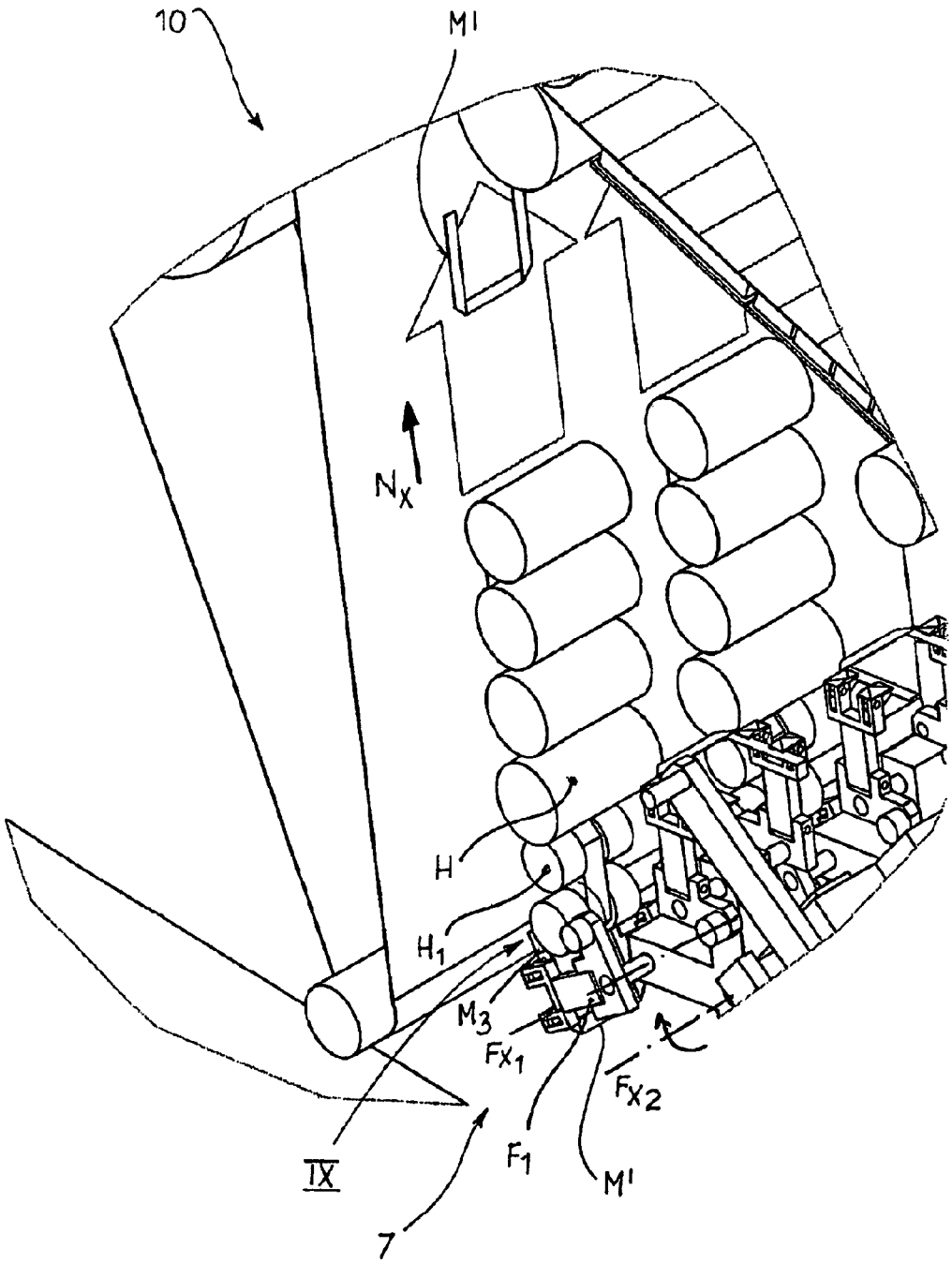
FIG. 8 shows the attachment (IX) of a folded strap (M') to the continuous roll of paper (N) by the loader (F) and the pressing of the folded strap (M') itself onto the roll (N) by a plurality of rollers (H, H1)

The handle-forming machine (10) comprises at least one loader (F) rotating around at least one axis (Fx1, Fx2) parallel to the main shaft (Gx) of the carousel (G), able to grasp the folded strap (M') from the loading position (5) (FIG. 7) and to rotate around said axis (Fx1, Fx2) as far as the attachment position (7) (FIG. 8) of the strap (M') to said continuous roll of paper (N) which the bag will be made from, and where the folded strap (M'), in the attachment position (6), faces with its central side (M2) substantially orthogonal to the direction of advancement (Nx) of the continuous roll of paper (N), and with the folded sides (M3, M4) facing in the same direction as the direction of advancement (Nx) of the roll of paper (N) (FIG. 8).

The loader (F) comprises, in particular, one or more grippers (F1, F2) able to grasp the folded sides (M3, M4) of the strap (M') from the outside. Preferably, the peripheral rotation speed of the grippers (F1, F2) of the loader (F) is the same as the peripheral rotation speed of the cradles (C) of the carousel (G) at the moment of grasping of the strap (M') by the grippers (F1,F2). Such rotation speed of the grippers (F1,F2) and of the cradles (C) may, advantageously, be regulated and equalised so as to ensure the synchrony of gripping or grasping of the strap (M') by the grippers (F1,F2).

To ensure greater precision, the rotation of the loader and/or of the carousel is controlled by one or more motors on relative shafts, preferably of the "brushless", electronically controlled type.

The handle-forming machine (10) comprises one or more rollers (H, H1) pressing the straps (M') onto the continuous roll of paper (N), wherein the lateral sections (M3, M4) of the straps (M') are inserted by the loader (C) between the roll of paper (N) and the rollers (H, H1).

Figure 9:
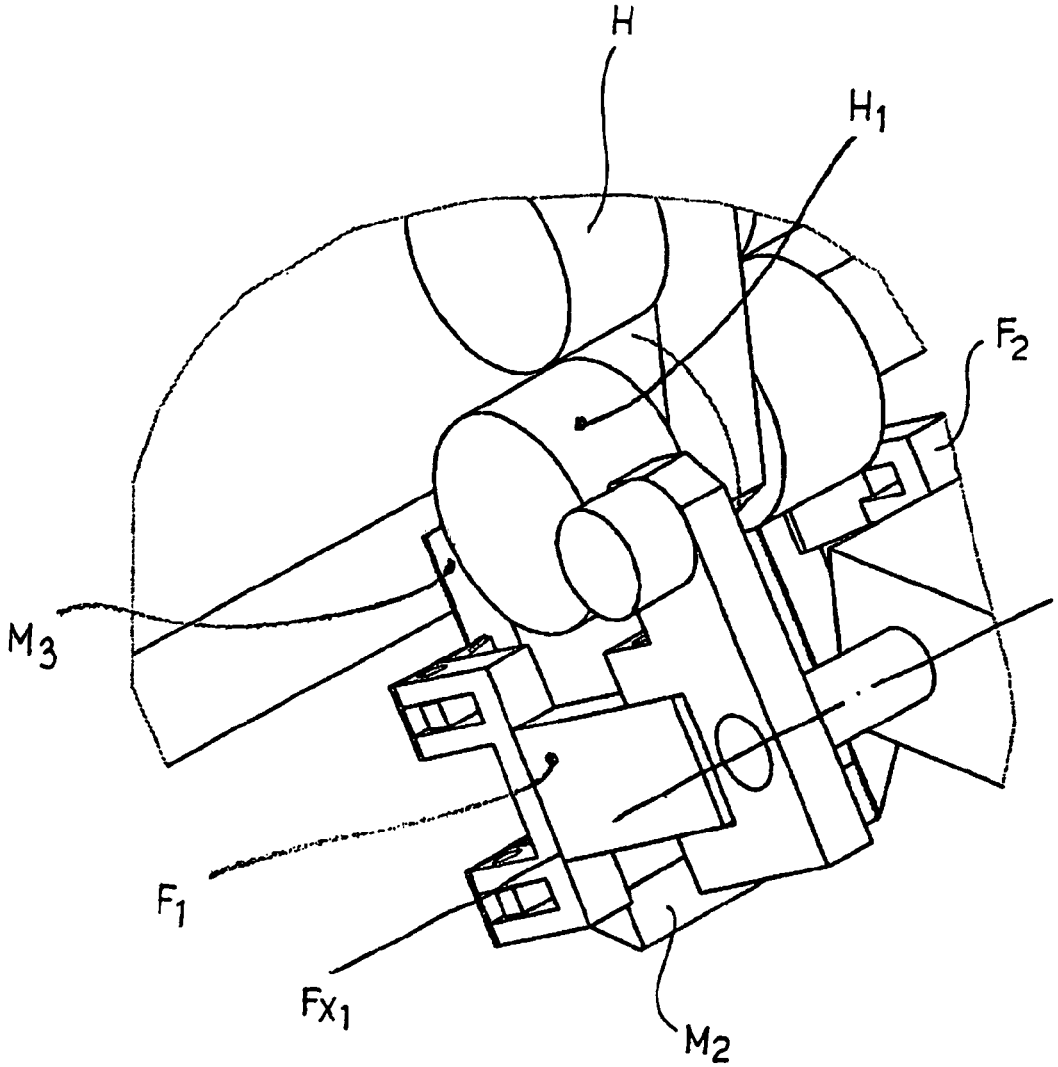
FIG. 9 shows the enlarged detail IX in FIG. 8.
Figure 10:
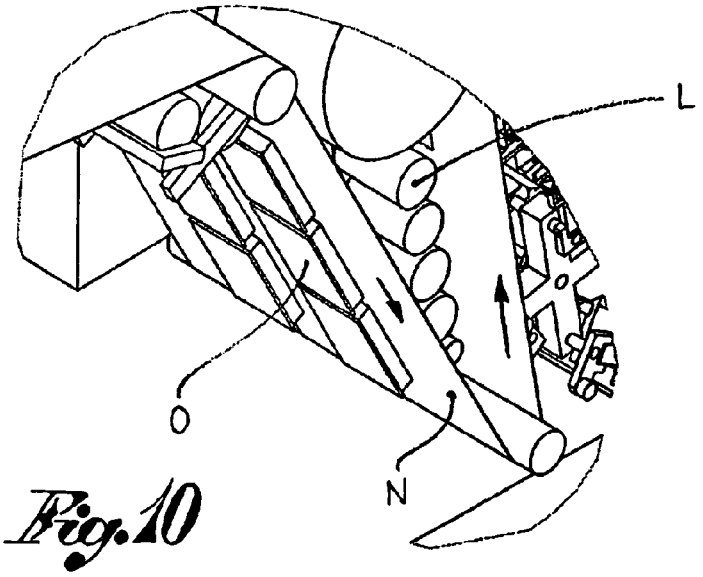
FIG. 10 shows devices for applying (L) and drying (O) the glue on the continuous roll of paper (N) in the areas where the straps (M') will be applied.
Figure 11:
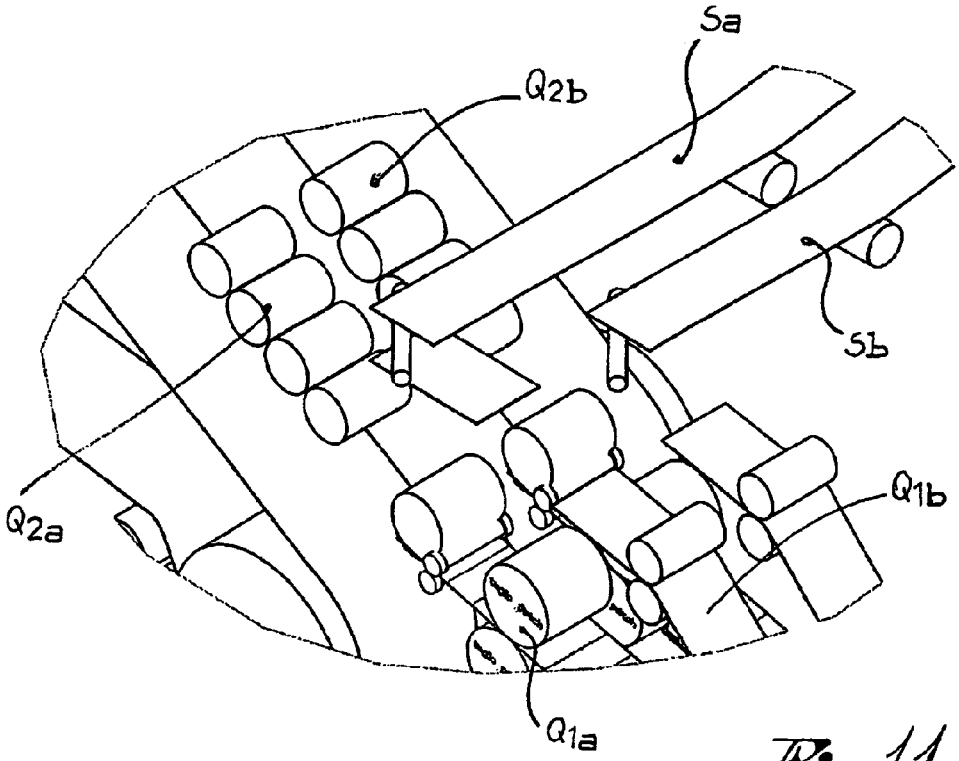
FIG. 11 shows a device for cutting (Q1) and attaching (Q2) the reinforcement patches (Sa, Sb) of the straps (M').

At least the first of said rollers (H1) has a total overall width less than the length of the central side (M2) of the strap (M'), so that the grippers of the loader (F) do not collide with the roller (H1) itself, as shown in FIG. 9.

For the attachment of each strap (M') to the roll of paper (N), the rollers (H,H1) run over the roll of paper (N) and the folded sides (M3,M4) of the straps (M') are inserted between the roll of paper (N) and the rollers (H,H1). During the attachment phase of the strap (M') to the associable roll of paper (N) the speed of advancement of the strap (M') adjusts to the speed of advancement of the roll of paper (N). Such adjustment of the speed of advancement of the strap and of the roll of paper is preferably performed using numerically controlled "brushless" type motors.

The folded sides (M3, M4) of the straps (M') are then pressed onto the roll of paper (N) which the glue was previously applied to.

In this regard, the handle-forming machine (10) may also comprise one or more devices for applying (L) and drying (O) the glue on the roll of paper (N) in the area where the folded straps (M') will be applied. According to one embodiment, the handle-forming machine (10) comprises at least one device for cutting (Q1*a*, Q1*b*) and attaching (Q2*a*, Q2*b*) reinforcement patches (Sa, Sb) of the straps (M') to the continuous roll of paper (N) after the application of the straps (M') to the said roll, wherein the reinforcement patches (Sa, Sb) are fed from at least one feed station (S).

As may be seen from the description, the handle-forming machine according to the present invention, makes it possible to resolve the drawbacks and limitations of the prior art.

In fact, the handle-forming machine according to the present invention makes it possible to increase the hourly production of bags and carrier bags, maximising the speed of the shaping and attachment phase of the strap handles. Such hourly production increase does not entail any reduction in reliability of the equipment which proves reliable and free of jamming.

In fact, first of all the straps are gripped by innovative mechanical grippers in place of the conventional systems using vacuums: this way the inevitable jamming caused by vacuum mechanisms is avoided.

Moreover, the gripping of the strap is improved in that it occurs in a parallel not transversal, and continuous manner. The speed of the cradle is equalised to the speed of the tape to be gripped and only after gripping is the strap cut to size. In other words, the preformed strap is only cut after being grasped by the mechanical grippers, thereby preventing any possibility of it falling in the first changeover.

Moreover, the cut tape is retained by said mechanical gripper for the entire handle-forming process, avoiding changeovers with other gripping mechanisms which would add to the risk of dropping said handle.

The synchronism of all the parts of the handle-forming machine, and in particular of the speed of rotation of the grippers and of the cradles, as well as of the speed of rotation of the cradles and the speed of advancement of the roll of paper, is ensured by the use of numerically controlled motors.

The guarantee of synchronism, together with the fact that the handle is always retained by the same gripper without any further exchange, enables a production speed of paper bags double that of the handle-forming machines of the prior art.

Moreover, the carousel according to the present invention makes it possible to incorporate in a single element all the main gripping, cutting and folding operations of the strap to form the handle to apply to the associable bag. The present invention therefore permits, for the same functioning, a considerable reduction in size compared to the devices of the prior art.

A person skilled in the art may make numerous modifications and variations to the handle-forming machines described above so as to satisfy contingent and specific requirements while remaining within the sphere of protection of the invention as defined by the following claims.

The invention claimed is:

1. A handle-forming machine for shaping and applying strap handles to bags or carrier bags in paper or other material, and/or to continuous rolls of paper for the production of bags or carrier bags, the strap handles being formed substantially by folding into a U shape at least one strip or strap, in paper or other material, characterised by the fact of comprising at least one carousel rotating around a main shaft, the carousel in turn comprising: guides which cause the raising and folding of two opposite end sections of the strap, so that it is substantially folded into a U shape, having a central section and two lateral sections, and wherein the folded strap is positioned, in the folding position, with the central section parallel to the main shaft of the carousel, and the lateral sections facing in the opposite direction to the direction of rotation around the main shaft, one or more cradles for gripping and folding the straps, wherein each cradle:

comprises one central gripper which retains the central section of the folded strap, and two further lateral grippers which respectively retain the two lateral sections of the folded strap, rotates jointly with the carousel around the main shaft at least from one feed station of said strap/s, to one folding station of each strap into a U shape and to one loading station of the folded strap handle, for attachment to the bag or continuous roll of paper which the bag will be made from, and said cradle is mounted so as to swivel around its own axis radial to the main shaft, to rotate the position of the relative strap between the feed, folding and loading stations.

2. The handle-forming machine according to claim 1, wherein the carousel comprises a plurality of arms substantially radial to the main shaft, and said cradles are each mounted on the end of one of said arms, so as to be positioned radially on the carousel.

3. The handle-forming machine (10) according to claim 1, wherein each cradle comprises one or more grippers to grasp the at least one strap in one or more points.

4. The handle-forming machine according to claim 1, wherein the rotation of the carousel, around the main shaft, and the rotation of the cradles, each around its own radial axis, are synchronised so as to fold each strap substantially into a U shape.

5. The handle-forming machine according to claim 1, comprising at least two series of cradles and two series of radial arms rotating in a synchronised manner around the main shaft and the radial axis, each cradle and the relative arm of one series being flanked with a relative cradle and relative arm of the second series.

6. The handle-forming machine according to claim 5, comprising at least unwinding and folding station of a pair of continuous flanked strips for the realisation of the straps, one for each of said series of cradles, wherein each of the strips is folded once or more in the longitudinal direction of the strip to stiffen the straps obtained.

7. The handle-forming machine according to claim 6, comprising at least one rotor with knives for cutting the continuous strips to size, each strip being grasped by at least one gripper of one of said cradles situated in the feed position, and wherein said rotor/s cuts each of the strips to size forming one straight linear strap grasped by the relative cradle which continues in rotation around said main shaft and around the relative radial axis.

8. The handle-forming machine according to claim 7, wherein the cradle in the feed position is positioned so that the initially straight linear strap, is positioned tangentially to the rotary movement of the cradle around the main shaft and orthogonally to the main shaft itself.

9. The handle-forming machine according to claim 7, wherein the cradle rotates around said main shaft from the feed position of the strap as far as a scoring position of the strap along the folding lines, and wherein the cradle rotates around the relative radial axis by 90°, placing the strap parallel to the main shaft in the scoring or punching position.

10. The handle-forming machine according to claim 1, wherein the cradle further rotates around the main shaft from the folding position to a loading position, contemporarily rotating around the relative radial axis by 180°, so that the folded strap has the central section positioned parallel to the main shaft and the lateral sections facing in the same direction as the direction of rotation around the main shaft.

11. The handle-forming machine according to claim 1, comprising a loader rotating around at least one axis parallel to the main shaft of the carousel, able to grasp the folded strap from the loading position and to rotate around the axis as far as the attachment position of the strap to said continuous roll of paper which the bag will be made from, and where the folded strap, in the attachment position, faces with its central side substantially orthogonal to the direction of advancement of the continuous roll of paper, and two lateral sections facing in the same direction as the direction of advancement.

12. The handle-forming machine according to claim 11, wherein the loader comprises one or more grippers able to grasp from the outside the lateral sections of the strap, and wherein the peripheral rotation speed of the grippers of the loader is the same as the peripheral rotation speed of the cradles of the carousel.

13. The handle-forming machine according to claim 1, comprising one or more rollers pressing the straps onto the continuous roll of paper, wherein the lateral sections of the straps are inserted by the loader between the roll of paper and the rollers themselves, and wherein at least the first of said rollers has a total overall width less than the length of the central section of the strap, so that the grippers of the loader do not collide with the roller itself.

* * * * *